US008237527B2

(12) United States Patent
An

(10) Patent No.: US 8,237,527 B2
(45) Date of Patent: Aug. 7, 2012

(54) BISTABLE PERMANENT MAGNETIC ACTUATOR

(75) Inventor: Young Gyu An, Chungcheongbuk-Do (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 0 days.

(21) Appl. No.: 13/115,839

(22) Filed: May 25, 2011

(65) Prior Publication Data

US 2011/0304417 A1 Dec. 15, 2011

(30) Foreign Application Priority Data

Jun. 10, 2010 (KR) ..... 10-2010-0055037

(51) Int. Cl.
*H01F 7/00* (2006.01)

(52) U.S. Cl. ..... 335/229; 335/230; 335/234; 335/266; 310/12.24; 310/13

(58) Field of Classification Search ..... 335/209, 335/220, 222, 229, 230, 234, 266; 310/12.29, 310/12.22, 12.23, 12.24, 13, 194, 27
See application file for complete search history.

(56) References Cited

U.S. PATENT DOCUMENTS

| | | | | |
|---|---|---|---|---|
| 2,899,609 | A * | 8/1959 | Andrews | 335/255 |
| 3,161,793 | A * | 12/1964 | Laithwaite | 310/27 |
| 4,612,592 | A * | 9/1986 | Frandsen | 360/266.9 |
| 6,020,567 | A * | 2/2000 | Ishikawa et al. | 218/154 |
| 6,373,675 | B1 * | 4/2002 | Yamazaki et al. | 361/135 |
| 6,476,702 | B1 * | 11/2002 | Hartwig et al. | 335/220 |
| 7,800,470 | B2 * | 9/2010 | Wright et al. | 335/229 |
| 7,982,567 | B2 * | 7/2011 | Cartier Millon et al. | 335/229 |
| 2002/0153982 | A1 | 10/2002 | Jones et al. | |
| 2008/0204174 | A1 | 8/2008 | Ito et al. | |
| 2008/0290972 | A1 * | 11/2008 | Jotter et al. | 335/229 |
| 2010/0060393 | A1 | 3/2010 | Joo et al. | |
| 2010/0164661 | A1 * | 7/2010 | Sohn | 335/229 |

FOREIGN PATENT DOCUMENTS

| | | | |
|---|---|---|---|
| EP | 1710813 | | 10/2006 |
| JP | 58099256 | A * | 6/1983 |
| JP | 63181660 | A * | 7/1988 |
| JP | 07294363 | A * | 11/1995 |
| WO | 2009109444 | | 9/2009 |

* cited by examiner

*Primary Examiner* — Mohamad Musleh
(74) *Attorney, Agent, or Firm* — Lee, Hong, Degerman, Kang & Waimey

(57) ABSTRACT

A permanent magnetic actuator includes a flux inducing unit having a hollow space therein and formed by laminating a plurality of plates, a movable element disposed in the hollow space of the flux inducing unit to be reciprocated, permanent magnets installed at inner walls of the hollow space, and guide members located between the permanent magnets and the movable element and configured to guide reciprocating motion of the movable element.

6 Claims, 4 Drawing Sheets

BISTABLE PERMANENT MAGNETIC ACTUATOR

CROSS-REFERENCE TO RELATED APPLICATION

Pursuant to 35 U.S.C. §119(a), this application claims the benefit of earlier filing date and right of priority to Korean Application No. 10-2010-0055037, filed on Jun. 10, 2010, the contents of which is incorporated by reference herein in its entirety.

BACKGROUND OF THE INVENTION

1. Field of the Invention

This specification relates to a bistable permanent magnetic actuator, and more particularly, an actuator for working a circuit breaker and a switch of electric power equipment using a magnetic force of a permanent magnet.

2. Background of the Invention

In regard of a low voltage circuit breaker of about several hundred volts, and a high voltage circuit breaker of several kilovolts or more or a super high voltage circuit breaker of several hundred kilovolts or more, widely used types of actuators for providing a driving force to switch on or off (open or close) contact points generally include a spring type, which uses elastic energy accumulated in a spring to obtain a switching driving force, and a hydro-pneumatic type, which uses hydraulic pressure and air pressure to obtain the switching driving force.

However, the spring type actuator has the structure of providing the switching driving force by cooperation with many mechanical components, which may be difficult to acquire operation reliability. Furthermore, the hydro-pneumatic type actuator provides a switching driving force sensitive to the change in temperature, which may also be difficult to acquire the operation reliability.

To overcome such problems, in recent time, a so-called permanent magnetic actuator using a permanent magnet and electric energy is being used instead of the existing actuators. The permanent magnetic actuator is configured to secure (fix) a movable element therein to be movable within a predetermined stroke using the magnetic force of the permanent magnet and make the movable element moved within the stroke by interaction of a magnetic force generated by supplying electric energy to a coil. In response to the movement of the movable element, a circuit breaker is opened or closed.

The permanent magnetic actuators may be classified into a bistable type and a monostable type according to the type of movable element (member) being secured at a certain position. The bistable type has a structure that the movable element is fixed by the permanent magnet at both ends of a certain stroke, and the monostable type has a structure that the movable element is fixed at one of both ends of the stroke.

Among the two types, the bistable permanent magnetic actuator is more advantageous than the monostable type requiring a separate suspending member, in the aspect that the movable element is fixed by the magnetic force of the permanent magnet so as to allow a closing/opening operation without a separate member in both cases of performing opening and closing operations with respect to electric power equipment, namely, bidirectionally moving the movable element.

FIG. 1 is a sectional view showing an embodiment of a bistable permanent magnetic actuator. As shown in FIG. 1, the actuator includes an upper cylinder 14 having an upper coil 12 wound therein, a middle cylinder 18 located at a lower side of the upper cylinder 14 and fixing a permanent magnet 16, and a lower cylinder 22 having a lower coil 20 wound therein. The upper, middle and lower cylinders are assembled to define a hollow hole, in which a movable element 24 is installed to be movable up and down. An open spring 26 is installed at one end of the movable element 24.

Referring to FIG. 1, the movable element 24 remains secured by the magnetic force of the permanent magnet 16 in a contact state with a protruded portion of the lower cylinder 22. Under this state, when a current is applied to the upper coil 12, as shown in FIG. 2, the upper cylinder 14 is magnetized to apply an upward force to the movable element 24. Once the force becomes stronger than the magnetic force of the permanent magnet 16, the movable element 24 is moved up to be in a state shown in FIG. 3.

In this state, the movable element 24 remains in the state shown in FIG. 3 by virtue of the magnetic force of the permanent magnet 16 even if the current is blocked. Afterwards, when a current is applied to the lower coil 20, the lower cylinder 22 is magnetized and thereby the movable element 24 is moved down to be back into the state shown in FIG. 1. As such, the movable element can be reciprocated up and down by applying the current to the upper and lower coils, respectively, and the reciprocating motion of the movable element allows the circuit breaker to be tripped/closed.

Here, the open spring 26 is compressed when the movable element 24 is located at a lower side, and decompressed when the movable element 24 is located at an upper side. Also, the open spring 26 is provided to more facilitate performing of an opening operation when a contact point is manually opened from external electric power equipment in a state that the permanent magnetic actuator is connected to the electric power equipment (circuit breaker or switch).

The related art permanent magnetic actuator having the structure has a merit in that such structure is simpler than other existing actuators and operates stably even without separate repair and maintenance. However, as shown in the drawings, each of the upper, middle and lower cylinders should be fabricated through a mechanical work, which requires a high machining cost. Also, such cylinders should be precisely assembled to ensure a smooth operation of the movable element. However, the precise assembly is difficult.

In addition, the permanent magnet should be processed into an annular shape, the processing cost for the magnet is also increased. Use of a single permanent magnet makes the assembly difficult due to the strong magnetic force of the permanent magnet. In view of the structure, the permanent magnet and the movable element are in a contact state, which may cause damages on the permanent magnet due to collision between the permanent magnet and the movable element during operation of the movable element.

SUMMARY OF THE INVENTION

Therefore, to overcome the drawbacks of the related art, an aspect of the detailed description is to provide a bistable permanent magnetic actuator capable of being easily fabricated and reducing a fabrication cost thereof.

Another aspect of the detailed description is to provide a permanent magnet actuator capable of minimizing concerns about damage on a permanent magnet, which may be caused by a movable element during operation.

To achieve these and other advantages and in accordance with the purpose of this specification, as embodied and broadly described herein, a permanent magnetic actuator including a flux inducing unit having a hollow space therein and formed by laminating a plurality of plates, a movable element disposed in the hollow space of the flux inducing unit to be reciprocated, permanent magnets installed at inner walls of the hollow space, and guide members located between the permanent magnets and the movable element and configured to guide reciprocating motion of the movable element.

In the aspect of this specification, the guide members may be provided between the permanent magnets and the movable element to prevent direct collision therebetween, thereby obviating damages on the permanent magnets. In addition, the flux inducing unit, which forms an outer appearance of the actuator and corresponds to the upper, lower and middle cylinders of the related art, may be more easily fabricated by laminating a plurality of plates. That is, intermediate products, which are produced by pressing plates, can be laminated to fabricate the flux inducing unit, which may allow easier fabrication than the machining into a complicated form and improve efficiency of using such materials.

Here, one side surface of each guide member may come in contact with the permanent magnet, and another side surface thereof may be in parallel to an inner wall of the hollow space.

Also, two of the permanent magnets may be respectively disposed at both inner walls of the hollow space with an inclination angle therebetween.

Support members may be disposed at both ends of each permanent magnet. The support members may be located between the corresponding permanent magnets so as to function as a type of flux barrier. Accordingly, flux saturation of the flux inducing unit and the guide members can be obviated and the flux can be concentrated on the movable element, thereby increasing a driving force and a fixing force for fixing the movable element.

In some cases, the permanent magnets may be spaced apart from one another, such that a space between the permanent magnet can function as a flux barrier.

Meanwhile, the movable element may include a pair of movable plates disposed at both end sides of the hollow space, and a coil interposed between the movable plates.

In the aspects of this specification with the configuration, the flux inducing unit, which forms an outer appearance of the actuator and induce flux to operate the movable element, can be configured by laminating plates, thereby being more easily fabricated with lower costs.

Also, the guide members may be disposed between the movable element and the permanent magnets so as to prevent damages on the permanent magnets, which may be caused due to collision against the movable element during operation of the movable element, thereby prolonging the lifespan of the device.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, description will be given in detail of exemplary embodiments of a permanent magnetic actuator in accordance with this specification, with reference to the accompanying drawing.

Figure 1:
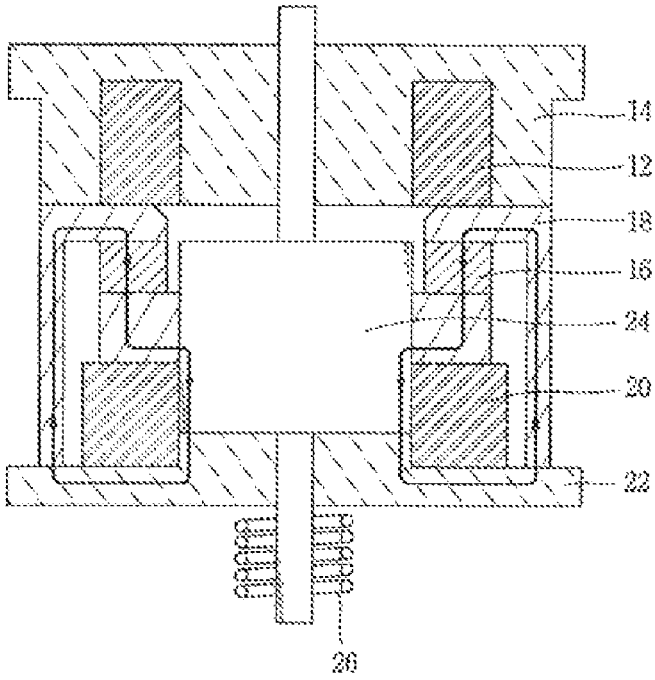
FIG. 1 (Prior Art)
FIG. 1 is a sectional view schematically showing a structure of a general bistable permanent magnetic actuator according to the related art.
Figure 2:
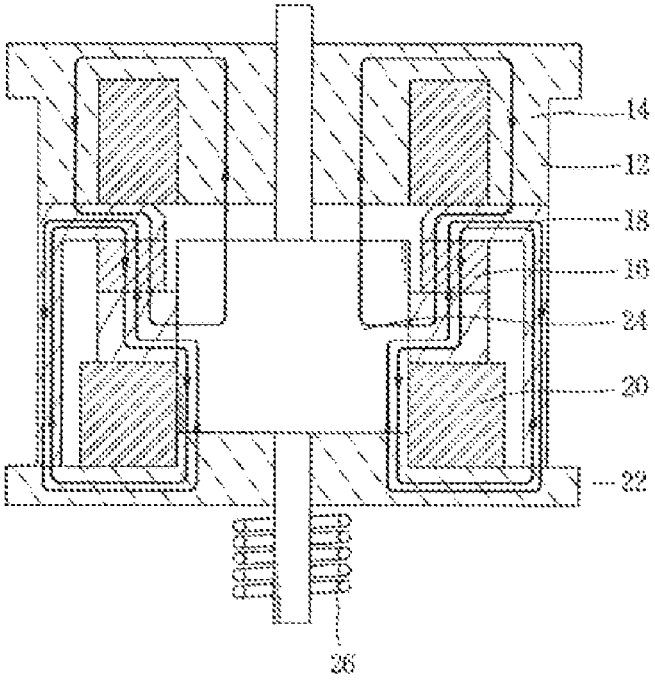
FIG. 2 (Prior Art)
FIGS. 2 and 3 are sectional views each showing an operating state of the permanent magnetic actuator shown in FIG. 1.
Figure 3:
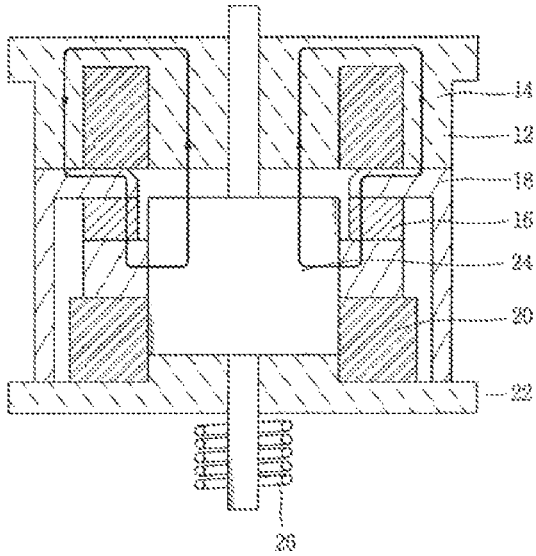
FIG. 3 (Prior Art)
Figure 4:
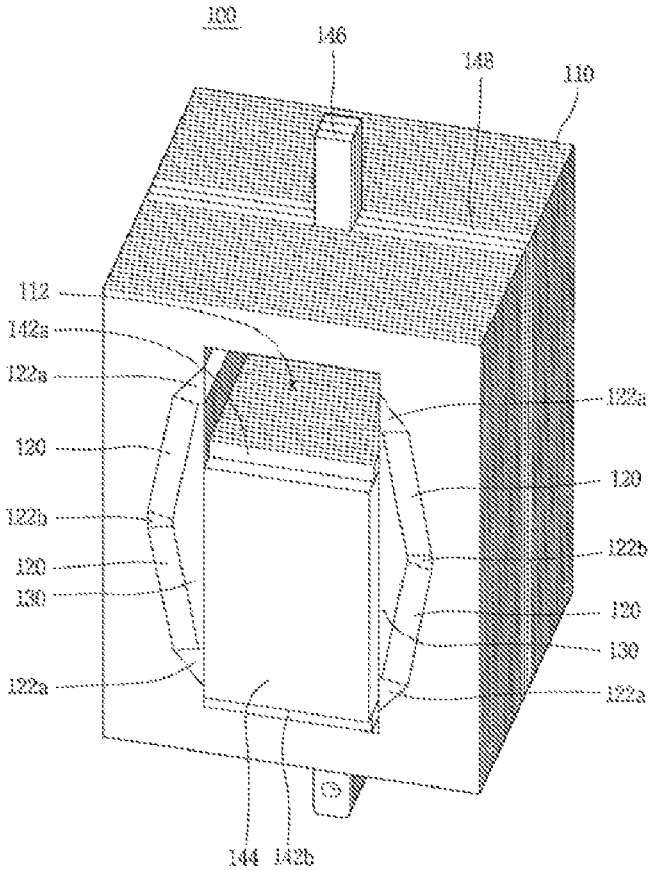
FIG. 4 is a perspective view showing one exemplary embodiment of a permanent magnetic actuator.
Figure 5:
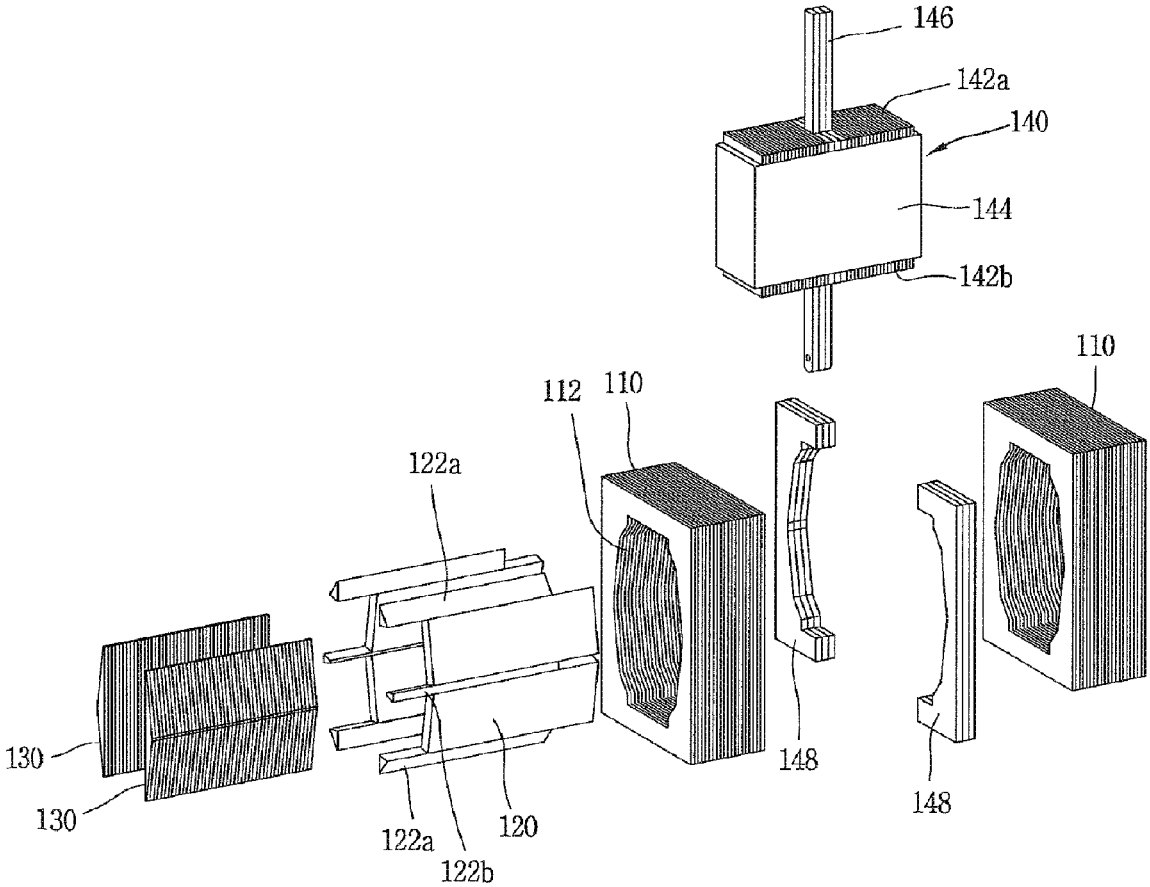
FIG. 5 is a disassembled perspective view showing an assembled structure of the exemplary embodiment shown in FIG. 4.
Figure 6:
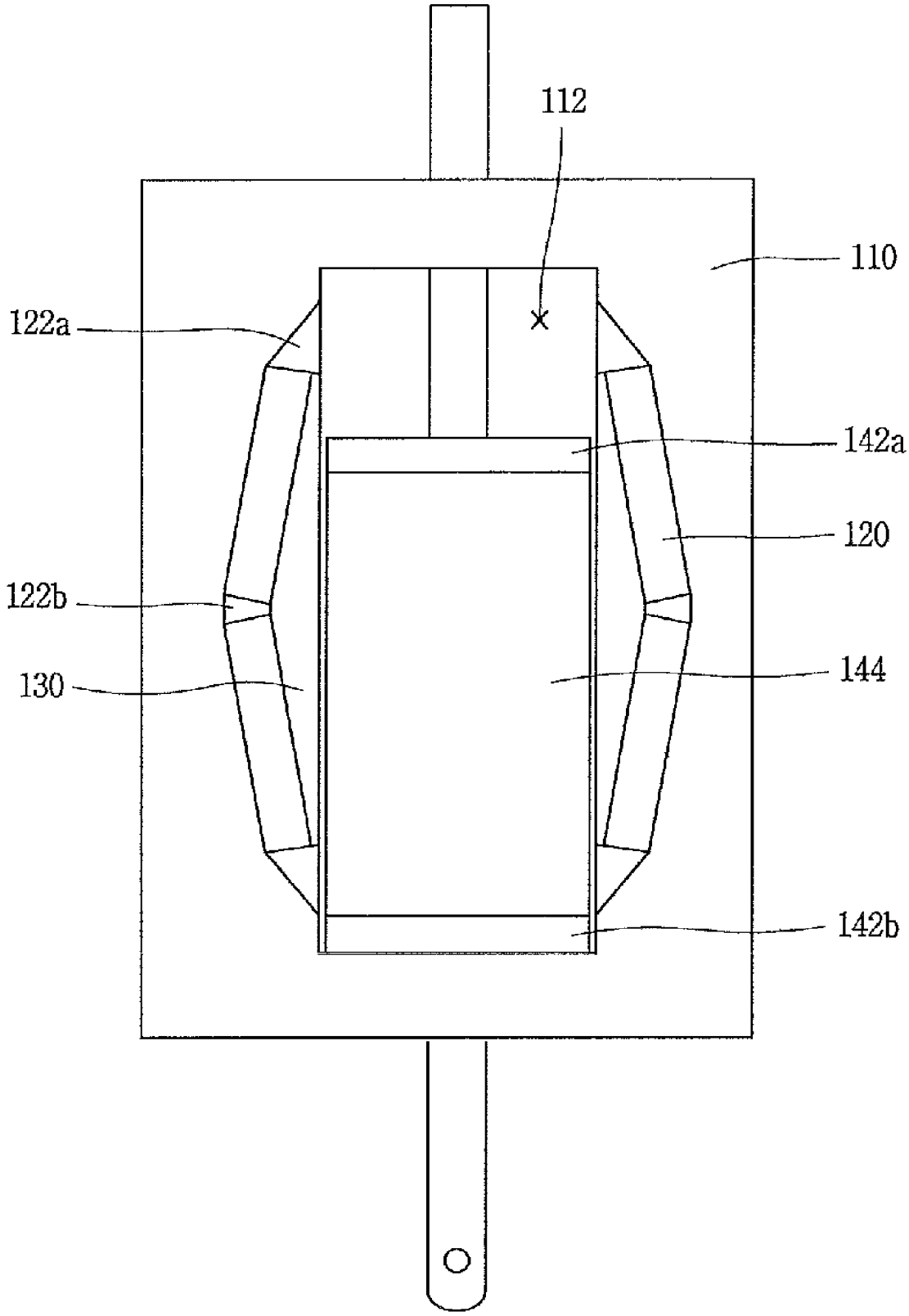
FIG. 6 is a sectional view showing an operating state of the exemplary embodiment shown in FIG. 4.

FIG. 4 is a perspective view showing one exemplary embodiment of a permanent magnetic actuator, FIG. 5 is a disassembled perspective view showing the assembled structure of the permanent magnetic actuator, and FIG. 6 is a sectional view showing an inner structure of the permanent magnetic actuator.

As shown in FIG. 4, the permanent magnetic actuator 100 according to the exemplary embodiment may include a flux inducing unit 110 having an overall rectangular parallelepiped shape. The flux inducing unit 110, as shown, may have a structure that a plurality of plates, each having a hollow space 112 at a center thereof, are laminated to have a predetermined thickness. The hollow space 112 may have upper and lower surfaces formed in parallel to upper and lower surfaces of the flux inducing unit 110, and also have both side walls whose central portions are protruded to an outside of the flux inducing unit 110, respectively.

Two permanent magnets 120 may be disposed respectively at both side walls of the hollow spaces 112. Hence, the exemplary embodiment 100 may include totally four permanent magnets 120. The two permanent magnets 120 disposed at one side wall may be inclined with each other due to the shape of the side wall.

First and second support members 122*a* and 122*b* may be installed at both ends of each permanent magnet 120. Especially, the first support member 122*a* may be located at the outermost sides of two permanent magnets 120, respectively, and the second support member 122*b* may be located between the two permanent magnets 120. The first and second support members 122*a* and 122*b* may be made of a non-conductive substance so as to serve as flux barriers between the two permanent magnets 120.

Guide plates 130 may be disposed at surfaces of the permanent magnets 120, facing the hollow space 112. Each of the guide plates 130 may be formed by laminating a plurality of rectangular plates, but it may not always have to have such laminated structure. The guide plates 130 are relatively simple in structure, so they may be integrally formed through a typical mechanical work.

The guide plates 130 may be fixed in a contact state with the permanent magnets 120, and their hypotenuse sides may be exposed inside the hollow space 112. Here, the first support members 122*a*, the guide plates 130 and the hollow space 112, as shown in FIG. 4, may have a position relation that a surface defined as the components contact each other can be a flat surface so as to allow a movable element (member) 140, which will be explained later, to be smoothly reciprocated within the hollow space 112.

In the meantime, the movable element 140 may be mounted within a space defined by the hollow space 112, the guide plates 130 and the first supporting members 122*a* to be reciprocated up and down based on FIG. 4. In detail, the movable element 140 may include an upper movable plate 142*a* and a lower movable plate 142*b* located at upper and lower portions thereof, respectively, and a coil 144 wound between the upper and lower movable plates 142*a* and 142*b*. In addition, a movable element shaft 146 may be installed through the upper and lower movable plates 142*a* and 142*b*. Here, although not shown, the upper and lower movable plates 142*a* and 142*b* may be connected by a connecting member and thus substantially have a shape like an alphabet "H." The coil 144 may be wound around the connecting member.

Also, the upper and lower movable plates 142*a* and 142*b* and the connecting member may also be formed in a laminated structure of a plurality of plates. To support the movable element 140, support plates 148 may be interposed between the flux inducing units 110. The support plates 148 may be provided as a pair, facing each other, and fix the movable element shaft 146 therebetween.

Hereinafter, description will be given of an operation of the exemplary embodiment with reference to FIG. 6.

FIG. 6 shows a fixed state of the movable element 140 with being in contact with the lower portion of the hollow space 112. Under this state, flux generated by the permanent magnets 120 forms a magnetic circuit defined by the guide plates 130, air gaps between the guide plates 130 and the movable element 140, the lower movable plate 142*b* and the flux inducing unit 110. Accordingly, the magnetic force of the permanent magnets 120 is applied to the lower movable plate 142*b*. Consequently, the movable element 140 remains in the state shown in FIG. 6 unless an external force stronger than a predetermined force is applied thereto.

In this state, when a forward current is applied to the coil 144, an upward force is applied to the movable element 140 according to Fleming's left hand rule. When the force becomes stronger than the magnetic force of the permanent magnets 120, the movable element 140 moves up to come in contact with an upper wall of the hollow space 112. Here, even if the current supply is stopped, the magnetic force of the permanent magnets 120 is applied to the upper movable plate 142*a* such that the movable element 140 can remain contacted with the upper wall.

Afterwards, when a reverse current is applied to the coil 144, a downward force is applied to the movable element 140. When the force becomes stronger than the magnetic force of the permanent magnets 120, the movable element 140 comes in contact with a lower wall of the hollow space 112 to move back to the state shown in FIG. 6.

As such, the movable element 140 can move up or down according to a direction of applying current to the coil 144, and this mechanism can be used to operate a circuit breaker or a switch. During those processes, the movable element 140 may merely come in contact with the guide plates 130 and the flux inducing unit 110 or the first support members 122*a* without contact with the permanent magnet 120, which results in minimizing damages on the permanent magnets 120 due to collision against the movable element 140.

In addition, the first and second support members 122*a* and 122*b* may serve as flux barriers so as to minimize (prevent) flux saturation of the guide plates 130 and concentrate flux into the movable element 140, thereby increasing a driving force and a fixing force, by which the movable element 140 can be fixed to the upper wall or a lower wall of the hollow space 112.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A permanent magnetic actuator comprising:

a flux inducing unit comprising a hollow space and formed by laminating a plurality of plates;

a movable element disposed in the hollow space of the flux inducing unit, wherein the movable element is configured to reciprocate by moving up and down in the hollow space;

a coil wound around the movable element;

a pair of support plates disposed between the laminated plurality of plates such that the support plates fix a shaft of the movable element between the pair of support plates;

permanent magnets installed between inner walls of the hollow space; and guide members located between the permanent magnets and the movable element and configured to guide a reciprocating motion of the movable element.

2. The actuator of claim 1, wherein:

a first side surface of each guide member comes in contact with one of the permanent magnets, and a second side surface of each guide member is parallel to one of the inner walls of the hollow space.

3. The actuator of claim 2, wherein two permanent magnets are each disposed at each of two inner walls of the hollow space such that an inclination angle exists between each of the two permanent magnets and the corresponding one of the two inner walls.

4. The actuator of claim 3, further comprising:

support members disposed at both ends of each of the two permanent magnets.

5. The actuator of claim 3, wherein a spaced interval exists between the two permanent magnets.

6. The actuator of claim 1, wherein the movable element comprises:

a pair of movable plates each disposed at an end side of the hollow space, wherein the coil is interposed between the movable plates.

* * * * *